US010281195B2

(12) United States Patent
Cakirca et al.

(10) Patent No.: US 10,281,195 B2
(45) **Date of Patent: *May 7, 2019**

(54) HOME APPLIANCE DEVICE

(71) Applicant: BSH HAUSGERAETE GMBH, Munich (DE)

(72) Inventors: Volkan Cakirca, Istanbul (TR); Mehmet Ciyanoglu, Istanbul (TR); Emre Guentav, Istanbul (TR); Hueseyin Sen, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/361,552

(22) Filed: Nov. 28, 2016

(65) Prior Publication Data

US 2018/0149413 A1 May 31, 2018

(51) Int. Cl.

| | |
|---|---|
| ***F25D 23/06*** | (2006.01) |
| ***F25D 23/02*** | (2006.01) |
| ***F25D 23/04*** | (2006.01) |
| ***F25D 23/08*** | (2006.01) |
| ***F25D 27/00*** | (2006.01) |
| ***F25D 29/00*** | (2006.01) |

(52) U.S. Cl.

CPC ..... *F25D 23/067* (2013.01); *F25D 23/028* (2013.01); *F25D 23/04* (2013.01); *F25D 23/065* (2013.01); *F25D 23/08* (2013.01); *F25D 27/00* (2013.01); *F25D 29/005* (2013.01)

(58) Field of Classification Search

CPC ..... F25D 23/028; F25D 23/04; F25D 23/067; F25D 23/08; F25D 27/00

USPC ..... 312/401, 404, 405, 406, 319.2, 319.5; 248/27.1

See application file for complete search history.

(56) References Cited

U.S. PATENT DOCUMENTS

| | | | | |
|---|---|---|---|---|
| 3,836,221 | A * | 9/1974 | Whistler, Jr. | F25D 23/04 206/305 |
| 4,726,789 | A * | 2/1988 | Yaffe | B60K 37/04 439/297 |
| 4,966,004 | A * | 10/1990 | Midlang | F25D 29/005 200/302.2 |
| 5,169,097 | A * | 12/1992 | Yasukawa | B60K 37/04 248/27.1 |
| 2004/0216471 | A1 | 11/2004 | Kim et al. | |
| 2008/0203868 | A1* | 8/2008 | Leclear | D06F 39/00 312/237 |

(Continued)

FOREIGN PATENT DOCUMENTS

| | | | |
|---|---|---|---|
| DE | 102014206948 | A1 | 10/2015 |
| EP | 1990698 | A1 | 11/2008 |

(Continued)

*Primary Examiner* — James O Hansen

(74) *Attorney, Agent, or Firm* — Laurence A. Greenberg; Werner H. Stemer; Ralph E. Locher

(57) ABSTRACT

For the purpose of increasing flexibility a home appliance device, in particular a home chiller appliance device, is proposed. The novel device includes at least one functional housing, which is arranged at least largely within an insulation-receiving chamber and defines at least one receiving space for receiving at least one functional unit; and at least one attachment element which at least partly encompasses the functional housing in an assembled state.

13 Claims, 11 Drawing Sheets

(56) References Cited

U.S. PATENT DOCUMENTS

| | | | | |
|---|---|---|---|---|
| 2014/0306596 | A1* | 10/2014 | Linke | E05F 15/611 312/405 |
| 2015/0338156 | A1* | 11/2015 | Held | F25D 23/028 312/405 |
| 2016/0209110 | A1* | 7/2016 | Cho | F25D 23/062 |

FOREIGN PATENT DOCUMENTS

| | | | |
|---|---|---|---|
| WO | 2011147898 | A2 | 12/2011 |
| WO | 2014195221 | A1 | 12/2014 |
| WO | 2016169898 | A1 | 10/2016 |
| WO | 2016174149 | A1 | 11/2016 |

* cited by examiner

HOME APPLIANCE DEVICE

BACKGROUND OF THE INVENTION

The invention relates to a home appliance device, in particular a home chiller appliance device.

SUMMARY OF THE INVENTION

An objective of the invention is, in particular, to provide a home appliance device with improved characteristics regarding flexibility. This objective is achieved, according to the claimed invention. Further implementations and further developments of the invention may be gathered from the dependent claims.

In one aspect of the invention, which may in particular be considered in combination with as well as separately from other aspects of the invention, a home appliance device, in particular a home chiller appliance device, is proposed, comprising: at least one functional housing, which is arranged at least largely within an insulation-receiving chamber and defines at least one receiving space for receiving at least one functional unit, the functional housing being implemented self-supporting by having a reinforcement feature for at least substantially maintaining a shape of the functional housing during a foaming process of the insulation-receiving chamber.

By means of this aspect of the invention, in particular a flexibility of the home appliance device can be improved. In particular, an improved stability of the home appliance device may be achieved. Thus, in particular a fatigue strength and/or a durability of the home appliance device may be advantageously increased. In addition, an efficiency, in particular a manufacturing efficiency, an installation space efficiency, a component efficiency and/or a cost efficiency, can be improved. Moreover, a particularly high-grade ease of use may be obtained.

By a "home appliance device" is in particular to be understood at least a part and/or a portion, preferably a sub-assembly group, of a home appliance. The home appliance is in particular provided for storing and preferably tempering victuals such as beverages, meat, fish, vegetables, fruits, milk and/or dairy products in at least one operating state, advantageously for the purpose of enhancing a quality and/or a keepability of the stored victuals. For this purpose, the home appliance device may in particular comprise at least one home appliance housing which in particular defines at least one storage space and/or at least one home appliance door which, is in particular configured for closing and preferably sealing off the storage space. For example, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven, a steamer and/or a microwave. In this context, "configured" is in particular to mean specifically programmed, designed and/or equipped. By an object being configured for a certain function is in particular to be understood that the object implements and/or fulfills said certain function in at least one application state and/or operating state. The term "at least largely" is to mean, in particular, at least 55% or at least 65% or at least 75% or at least 85% or at least 95%.

Moreover, an "insulation-receiving chamber" is, in particular, to be understood as a space and/or a region which is filled with insulation material, for example foam insulation, in particular during a foaming process, and/or contains insulation material, for example foam insulation, in at least one operational state. In particular, the insulation-receiving chamber is defined and/or delimited by the home appliance door, in particular an inner wall and/or inner walls of the home appliance door, and/or by the home appliance housing, in particular an inner wall and/or inner walls of the home appliance housing. In particular, the insulation-receiving chamber is implemented spatially separate, for example isolated, with respect to the storage space. A "functional housing" is, in particular, to be understood as a housing, in particular a sub-housing of the home appliance device, which is, in particular, implemented separately from the home appliance door and/or the home appliance housing and which is for example at least in an assembled state connected to the home appliance door and/or the home appliance housing in a form-fit, a force-fit and/or an adhesively and/or cohesively bonded manner. In particular, the functional housing may be implemented in a plurality of parts and/or integrally. More preferably, the functional housing is arranged above the storage space and/or at a side of the home appliance which faces away from a base and/or a ground of the home appliance. In an assembled state the functional housing may be arranged such that the receiving space of the functional housing is at least partly, preferably at least largely and more preferably completely, accessible from an outside and in particular from an environment of the home appliance. In particular, the receiving space may have at least one or exactly one, receiving opening, in particular a front opening, which in particular delimits the receiving space and may be arranged at least substantially parallel to a main extension plane of the home appliance door and/or the home appliance housing. Moreover, in an assembled state the functional unit may be removably located within the receiving space of the functional housing in particular by inserting the functional unit into the receiving space and/or by removing the functional unit from the receiving space via the receiving opening. The functional unit may be implemented as a lighting unit and/or a ventilation unit. However, preferably the functional unit is implemented as a door opening assistance unit, which is in particular configured for reducing an opening force required for opening the home appliance door. For this purpose, the functional unit and in particular at least one functional element of the functional unit may contact the home appliance door in at least one operational state, e.g. when the door opening assistance is assisting in opening the door. In a different operational state, e.g. when the door opening assistance unit is not activated, the very same functional unit and in particular at least one functional element of the functional unit may not contact the home appliance door. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. "Implemented integrally" could in particular mean made of one piece. "Made of one piece" is, in particular, to mean, in this context, manufactured from one single piece, e.g. by production from one single cast and/or by manufacturing in a one-component or multi-component injection-molding process, and for example from a single blank. Moreover, a "main extension plane" of an object is, in particular, to be understood as a plane extending parallel to a largest side of an imaginary rectangular cuboid which only just entirely encloses the object and preferably extends through a geometric center of the object. Moreover, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°.

A "reinforcement feature" is in particular to mean a unit and/or a structure which is preferably implemented integrally with a base body of the functional housing and which is in particular configured to strengthen the functional housing, to reinforce the functional housing and/or to increase a mechanical stability of the functional housing, in particular against a pressure of the insulation material, in particular at least during a foaming process of the insulation-receiving chamber. Moreover, the expression "at least substantially maintaining a shape of the functional housing" is, in particular, to mean that the reinforcement feature is configured for preventing an excessive deformation of the functional housing, in particular at least during a foaming process of the insulation-receiving chamber, in particular in such a way that the functional unit can be inserted into the receiving space and/or removed from the receiving space after the foaming process and/or in at least one operational state of the home appliance. The reinforcement feature may also enlarge contact surfaces of the functional housing facing the insulation-receiving chamber and being in contact with the insulation material. This improves the bond between the functional housing and the insulation material.

The reinforcement feature may comprise at least one reinforcement element, which is arranged at least partly or at least largely or completely, within the receiving space. In particular, the reinforcement element is connected to an inner wall of the functional housing and preferably implemented integrally with the inner wall of the functional housing. In this way, a stability of the functional housing may be increased easily.

In particular, for the purpose of achieving a particularly rigid functional housing, the reinforcement feature may comprise at least one further reinforcement element, which is arranged at least partly or at least largely or completely, outside the receiving space. In particular, the further reinforcement element may be connected to an exterior side and/or an outer wall of the functional housing and may preferably be implemented integrally with the exterior side and/or outer wall of the functional housing. In particular, the further reinforcement element may be connected to the reinforcement element, which is in particular arranged within the receiving space. However, preferably the further reinforcement element and the reinforcement element are embodied separate and/or spaced apart from each other.

Moreover, it is proposed that the reinforcement feature and in particular the further reinforcement element may cover merely a portion, in particular less than 95% or less than 85% or less than 75%, of an exterior side and/or an outer wall of the functional housing. In this way, a mounting and/or assembling process of the functional housing can be advantageously improved.

Furthermore, it is proposed that the reinforcement feature may comprise at least two reinforcement elements, for example the reinforcement element and the further reinforcement element, which are shaped differently. As a result, the reinforcement feature can be adapted to a shape of the functional housing easily.

The reinforcement feature may comprise at least one reinforcement element, in particular the reinforcement element and/or preferably the further reinforcement element, which is honeycomb-shaped. In this way, a particularly rigid functional housing may be obtained.

It is also proposed that the reinforcement feature may comprise at least one reinforcement element, in particular the further reinforcement element and/or preferably the reinforcement element, which is rib-shaped. In this way, the reinforcement feature may be optimally adapted to a shape of the functional housing.

It is also proposed that at least one reinforcement element, in particular the reinforcement element and/or preferably the further reinforcement element, may be honeycomb-shaped and may be connected to an exterior side and/or an outer wall of the functional housing while at least one reinforcement element, in particular the further reinforcement element and/or preferably the reinforcement element, may be is rib-shaped and may be connected to the inner wall of the functional housing. In this way, a rigid functional housing results which still can be easily manufactured, e.g. by injection molding.

The functional housing may be implemented at least partly or least largely or completely of metal, like steel and/or aluminum. It is proposed that the functional housing may be implemented at least partly or at least largely or completely, of plastic. In this way, in particular, a manufacturing process of the functional housing may be simplified. The functional housing may be manufactured by plastic injection molding.

Additionally, it is proposed that the functional housing may have a fastening unit, in particular a first fastening unit, for fastening the functional housing to a home appliance housing, in particular the aforementioned home appliance housing, in particular to a front frame of the home appliance housing. The fastening unit, in particular the first fastening unit, may be configured for detachably connecting the functional housing to the home appliance housing during the manufacturing process. Thereby, the functional housing may, in particular, be mounted to the home appliance housing in a mounting direction which is at least substantially perpendicular to the receiving opening of the receiving space and/or to the main extension plane of the home appliance housing and/or preferably at least substantially parallel to the receiving opening of the receiving space and/or to the main extension plane of the home appliance housing. For mounting the functional housing to the home appliance housing, the functional housing may be moved in two directions which are at least substantially perpendicular with respect to each other. In this context, "at least substantially perpendicular" is in particular to mean an orientation of a direction with respect to a reference direction, in particular in a plane, wherein the direction and the reference direction include an angle of 90°, the orientation in particular having a deviation of less than 15°, advantageously of less than 10° and particularly advantageously of less than 2°. In this way, in particular, a particularly easy and/or secure mounting of the functional housing may be achieved.

In addition, it is proposed that the functional housing may have a sealing unit for sealing at least one electrical socket, in particular of the home appliance device, which may be located in at least one further receiving space of the functional housing, during the foaming process. The sealing unit may be implemented as a rubber seal, a gap seal, a chamber seal and/or a labyrinth seal. As a result of this, in particular, an effective sealing may be obtained.

In another aspect of the invention, which may in particular be considered in combination with as well as separately from other aspects of the invention, a home appliance device, in particular a home chiller appliance device, is proposed comprising: at least one functional housing, in particular the aforementioned functional housing, which is arranged at least largely within an insulation-receiving chamber, in particular the aforementioned insulation-receiving chamber, and defines at least one receiving space for receiving at least one functional unit, in particular the aforementioned functional unit; and at least one attachment element which at least partly or at least largely or completely, encompasses the functional housing, in particular in a circumferential direction, in an assembled state.

By means of this aspect of the invention, in particular a flexibility of the home appliance device can be improved. In particular, an improved stability and/or sealing of the home appliance device may be achieved. Thus, in particular a fatigue strength and/or a durability of the home appliance device may be increased.

An "attachment element" is, in particular, to be understood as an element which is, in particular, implemented separately from the home appliance door, the home appliance housing and/or the functional housing and which may, at least in an assembled state, be detachably, connected to the home appliance door, the home appliance housing and/or the functional housing during the manufacturing process. In particular, the attachment element is configured to cover, seal, hold, fasten and/or stabilize the functional housing. The home appliance device may comprise at least two attachment elements which at least partly or at least largely or completely, encompass the functional housing, which may be implemented differently and may fulfil and/or execute different functions and/or purposes.

The attachment element may be arranged at least largely or completely within the insulation-receiving chamber. In this way, in particular, an installation space efficiency may be improved. Moreover, a design of the home appliance may be improved.

The attachment element may be connected to the functional housing in an adhesively-bonded and/or cohesively-bonded manner. For the purpose of improving an assembly process, it is proposed that the attachment element may be connected to the functional housing in a form-fit and/or force-fit manner and in particular at least partly by a screw connection and/or by a snap-fit connection.

Furthermore, it is proposed that the attachment element may be implemented integrally. In this way, in particular, a fatigue strength and/or a durability of the home appliance device may be improved.

The attachment element may have at least one recess or opening or hole in particular for receiving at least one electrical connection element, for receiving at least one mechanical connection element, for receiving at least one pneumatical connection element and/or for a pass-through of insulation material, in particular foam material. As a result, in particular, a particularly high flexibility can be achieved. Moreover, tension and/or friction forces may be reduced. Also the structural strength of the attachment element can be increased.

It is also proposed that the attachment element may be mounted to the functional housing in a mounting direction which is at least substantially perpendicular to a receiving opening of the receiving space, in particular the aforementioned receiving space, and/or to the main extension plane of the home appliance housing. For mounting the attachment element to the functional housing, the attachment element may be moved in two directions which are at least substantially perpendicular with respect to each other. In this way, a particularly easy and/or secure mounting of the attachment element may be achieved. In particular, the attachment element may be moved in a first step downwards and in a second step backward in a viewing direction when standing in front of the home appliance.

The attachment element may be implemented at least partly, at least largely and/or completely of plastic. It is also proposed that the attachment element may be implemented at least partly, at least largely or completely of metal, in particular steel and/or aluminum. In particular, the attachment element may be made of a punching and bending part. By using metal, in particular, a fatigue strength and/or a durability of the home appliance device may be improved. The combination of a functional housing made of plastic and an attachment element made of metal may allow a purpose specific integration of a functional unit within a comparably cheap functional housing which itself may have a strong support by the attachment element.

According to an implementation of the invention, it is proposed that the attachment element may be implemented as a supporting frame which is configured for supporting the functional housing and/or attaching the functional housing to the home appliance housing. The attachment element may surround the functional housing at least at three sides, e.g. two essentially vertical sides and one essentially horizontal side of the functional housing. The attachment element may be support the functional housing only at the two essentially vertical sides. In particular forces acting from the functional unit onto the functional housing may be transferred into the attachment element and in particular may be transferred via the attachment element into the home appliance housing. As a result, a stability of the home appliance device may be advantageously improved. There may be at least one gap between the attachment element and the functional housing. In particular, the attachment element and the functional housing may contact each other essentially only by attachment elements of the attachment frame and holding elements of the functional housing. The gap may be filled with isolation material.

In addition, it is proposed that the attachment element may have a fastening unit, in particular a second fastening unit, for fastening the attachment element, in particular directly, and in particular the functional housing indirectly, to a home appliance housing, in particular the aforementioned home appliance housing, for example to the front frame of the home appliance housing. The fastening unit, in particular the second fastening unit, is, in particular, implemented separately from the first fastening unit. The fastening unit, in particular the second fastening unit, may be configured for detachably connecting the attachment element to the home appliance housing preferably at least partly by a snap-fit connection and/or more preferably by a screw connection during the manufacturing process. As a result of this, a strong and yet simple connection may be achieved.

According to one embodiment of the invention, it is proposed that the attachment element may be implemented as a cover for electronics, preferably for covering at least one electrical socket of the home appliance device, in particular the aforementioned electrical socket. As a result, a sealing and/or a functional safety of the home appliance device may be advantageously improved.

In a further aspect of the invention, which may in particular be considered in combination with as well as separately from other aspects of the invention, a home appliance device, in particular a home chiller appliance device, is proposed, comprising: at least one functional housing, in particular the aforementioned functional housing, which is arranged at least largely within an insulation-receiving chamber, in particular the aforementioned insulation-receiving chamber, and defines at least one receiving space for receiving at least one functional unit, in particular the aforementioned functional unit; and at least one front cover element covering the receiving space and in particular the receiving opening of the receiving space at least largely and having, in at least one direction, an extension which exceeds an extension of the receiving space in said direction by at least 5% or by at least 10% or by at least 15% or by at least 20% or by at least 30%. The direction may be a lateral direction of the front cover element. In particular, however, the direction is a longitudinal direction of the front cover element.

By means of this aspect of the invention, in particular a flexibility of the home appliance device can be improved. Moreover, the functional housing and in particular the functional unit can be protected from dirt, from dust and/or from damaging. In addition, a design of the home appliance may be improved. Furthermore, an efficiency, in particular a manufacturing and/or maintenance efficiency, an installation space efficiency, a component efficiency and/or a cost efficiency, can be advantageously improved.

A "front cover element" is, in particular, to be understood as an element which may, in particular, be implemented separately from the home appliance door, the home appliance housing and/or the functional housing, and which may be, at least in an assembled state, detachably, connected to the home appliance door, the home appliance housing and/or the functional housing. Particularly, the front cover element may be dimensionally stable. The front cover element and in particular a main extension plane of the front cover element may be arranged at least substantially parallel to the receiving opening and/or to the main extension plane of the home appliance door and/or the home appliance housing. The front cover element may be configured for covering the receiving space and at least one further component, like a further functional unit and/or installation parts. In addition, the front cover element may be implemented at least partly, at least largely or completely of metal, in particular steel and/or aluminum, and/or preferably plastic.

Moreover, it is proposed that the front cover element may be offset with respect to the receiving space at least viewed in a further direction which is at least substantially perpendicular to a main extension plane of the front cover element. In this case, in particular, a geometric center of the front cover element may be offset with respect to a further geometric center of the receiving space at least viewed in the further direction which is at least substantially perpendicular to the main extension plane of the front cover element. In this way, an improved covering and/or mounting of the front cover element may be achieved.

In particular, the front cover element may be implemented in a plurality of parts. However, in particular, for the purpose of increasing a stability of the front cover element and/or an ease of use, it is proposed that the front cover element may be implemented integrally.

Furthermore, it is proposed that the front cover element may have at least one, preferably exactly one, opening for a pass-through of at least one functional element, in particular an actuation element, of the functional unit. The opening may have an at least substantially rectangular and/or circular shape. By an "at least substantially circular and/or rectangular object", is to be understood in particular an object which differs from a circular and/or rectangular reference object by an area portion which is less than 20%, advantageously less than 15% and in particular advantageously less than 10%. In this way, a preferably simple actuation of the functional unit may be achieved.

Additionally, it is proposed that the front cover element may have a fastening unit, in particular a third fastening unit, for fastening the front cover element to a home appliance housing, in particular the aforementioned home appliance housing and preferably the front frame of the home appliance housing. The fastening unit, in particular the third fastening unit, may, in particular, be implemented separately from the first fastening unit and/or the second fastening unit. The fastening unit, in particular the third fastening unit, may comprise at least one fastening element or at least two or at least four or at least six fastening elements. The fastening unit, in particular the third fastening unit, may be configured for detachably connecting the front cover element to the home appliance housing, for example at least partly by a screw connection and/or by a snap-fit connection. In particular, the front cover element may, in particular, be mounted to the home appliance housing in a mounting direction which is at least substantially perpendicular to the receiving opening of the receiving space, to the main extension plane of the front cover element and/or to the main extension plane of the home appliance housing. In this way, in particular a particularly easy mounting of the front cover element may be achieved.

In particular, for achieving an easy and/or fast mounting, it is also proposed that the fastening unit, in particular the third fastening unit, may comprise at least one fastening element which is implemented as a snap-fit element. For example, all fastening elements of the fastening unit, in particular the third fastening unit, may be implemented as snap-fit elements.

Moreover, in a further embodiment, it is proposed that the fastening unit, in particular the third fastening unit, may comprise at least two fastening elements which are implemented differently. In particular, the fastening elements may be of the same base type, e.g. a connection head may be identical, but may have a different extend in a direction perpendicular to a front opening which in particular delimits the receiving space. As a result, the fastening unit, in particular the third fastening unit, can be adapted to a shape of the front cover element and/or the home appliance housing easily.

According to a further implementation of the invention, it is proposed that the front cover element may have at least one depression for detaching the front cover element, in particular from the home appliance housing and preferably the front frame of the home appliance housing, in particular without using tools and/or by merely using simple tools like a screwdriver. The front cover element may have several depressions wherein preferably a number of depressions is equal to a number of fastening elements of the fastening unit, in particular the third fastening unit, preferably such that each depression is allocated to one of the fastening elements. As a result, a particularly easy detaching, in particular without destroying the front cover element, may be achieved. The depressions may in particular be located at a border region of the front cover element.

In addition, it is proposed that the front cover element may comprise at least one front panel and at least one spacer element for supporting the front panel while preventing sink marks preferably by bearing against the home appliance housing and preferably the front frame of the home appliance housing. As a result of this, in particular, a design of the home appliance may be improved.

Herein the home appliance device is not to be limited to the application and implementation described above. In particular, for the purpose of fulfilling a functionality herein described, the home appliance device may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing an exemplary embodiment of the invention is shown. The drawing, the description and the claims contain a plurality of features in combination. The person having ordinary skill in the art will purposefully also consider the features separately and will find further expedient combinations.

If there is more than one specimen of a certain object, only one of these is given a reference numeral in the figures and in the description. The description of this specimen may be correspondingly transferred to the other specimens of the object.

DETAILED DESCRIPTION OF THE INVENTION

Figure 1:
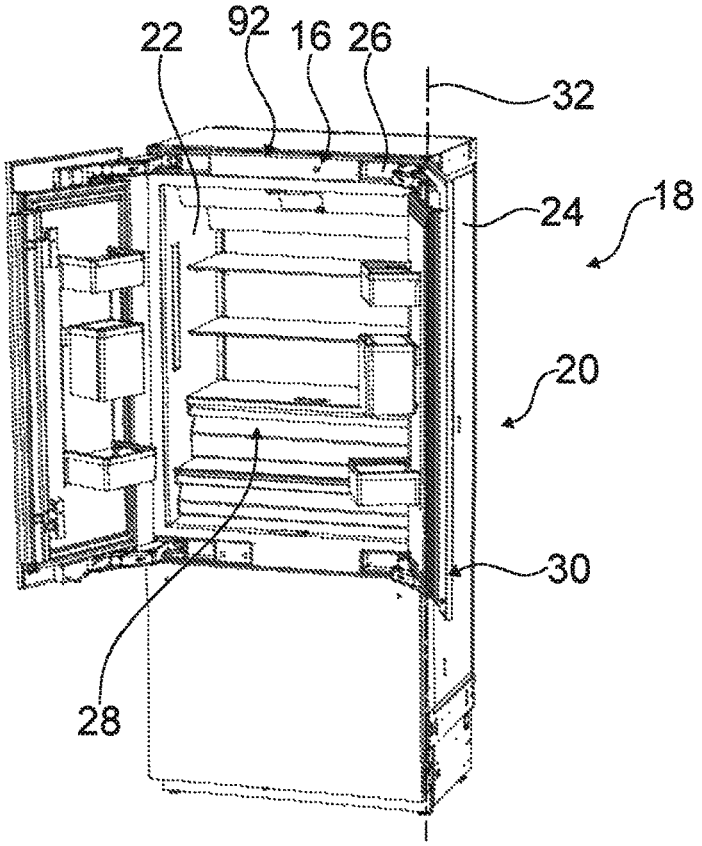
FIG. 1 a home appliance comprising a home appliance device, in a schematic front view, FIG. 2 a portion of the home appliance with the home appliance device, comprising a functional housing, a first attachment element, a second attachment element and a front cover element, in an exploded view, FIGS. 3*a-e* the functional housing in various perspective views, FIGS. 4*a-b* the functional housing in an assembled state, in perspective views, FIG. 5 the first attachment element, which is implemented as a supporting frame, in a perspective view, FIGS. 6*a-b* a mounting process of the first attachment element on the functional housing, FIGS. 7*a-c* the first attachment element attached to the functional housing, in various views, FIG. 8 a mounting process of the first attachment element onto a portion of a home appliance housing, FIGS. 9*a-b* the second attachment element which is implemented as a cover for electronics, in two perspective views, FIGS. 10*a-c* the second attachment element in an assembled state, in perspective views, FIGS. 11*a-d* the front cover element in various perspective views, FIG. 12 the front cover element in an assembled state, in a perspective view, and FIG. 13 a flow chart of a method for assembling the home appliance device.
Figure 2:
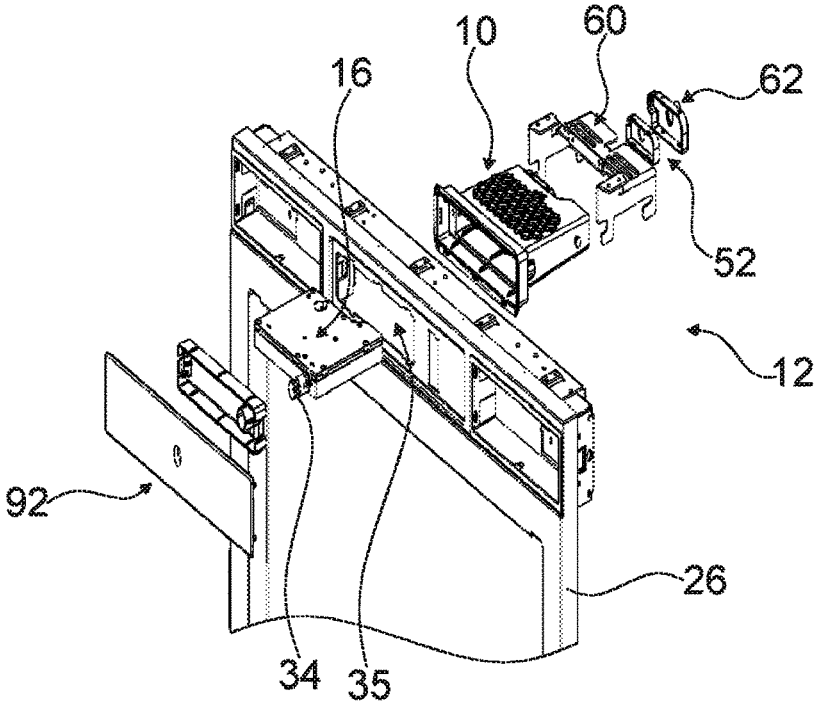
Figure 3A:
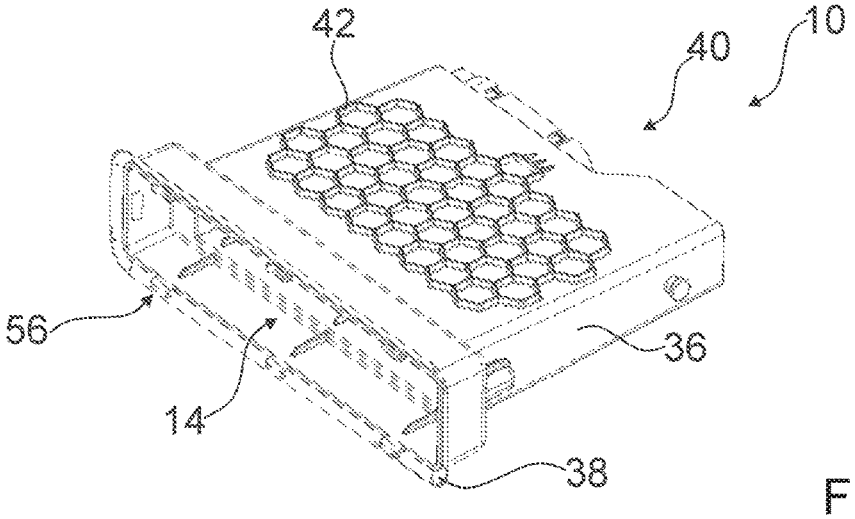
Figure 3B:
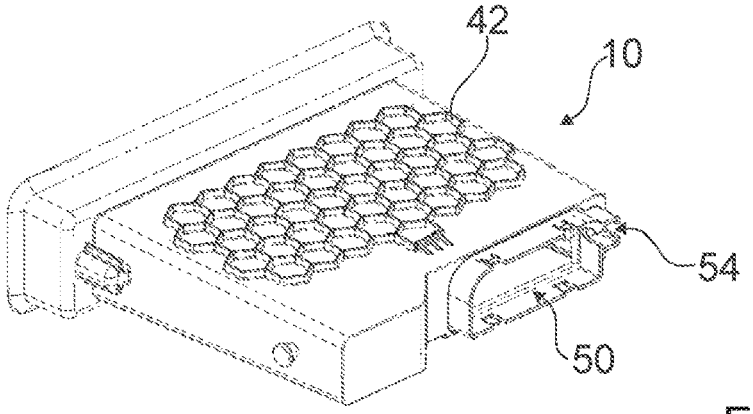
Figure 3C:
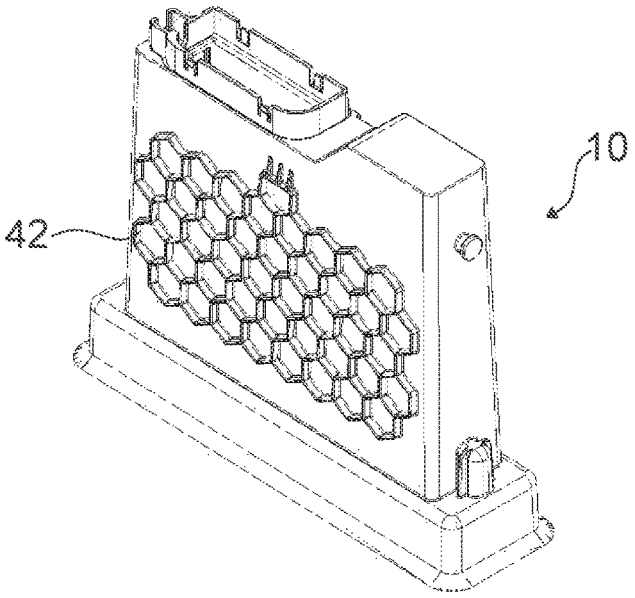
Figure 3D:
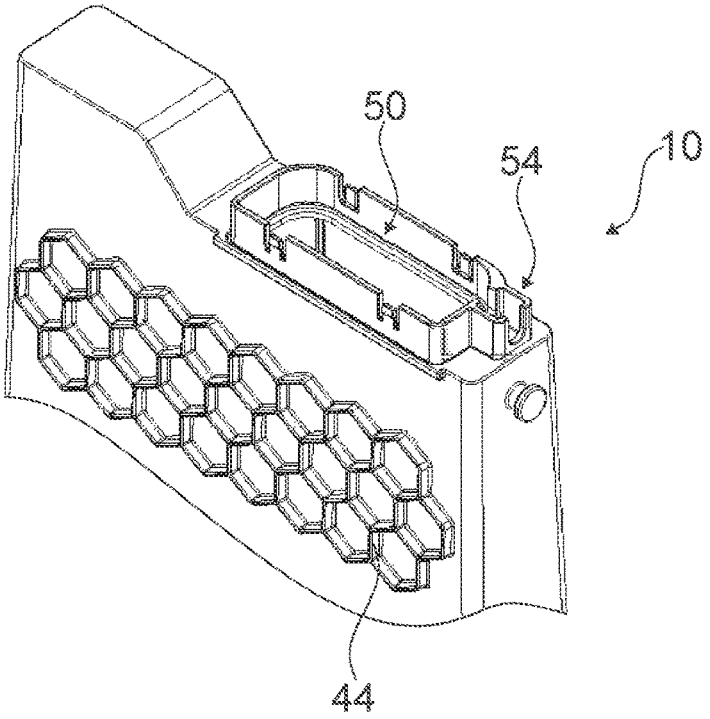
Figure 3E:
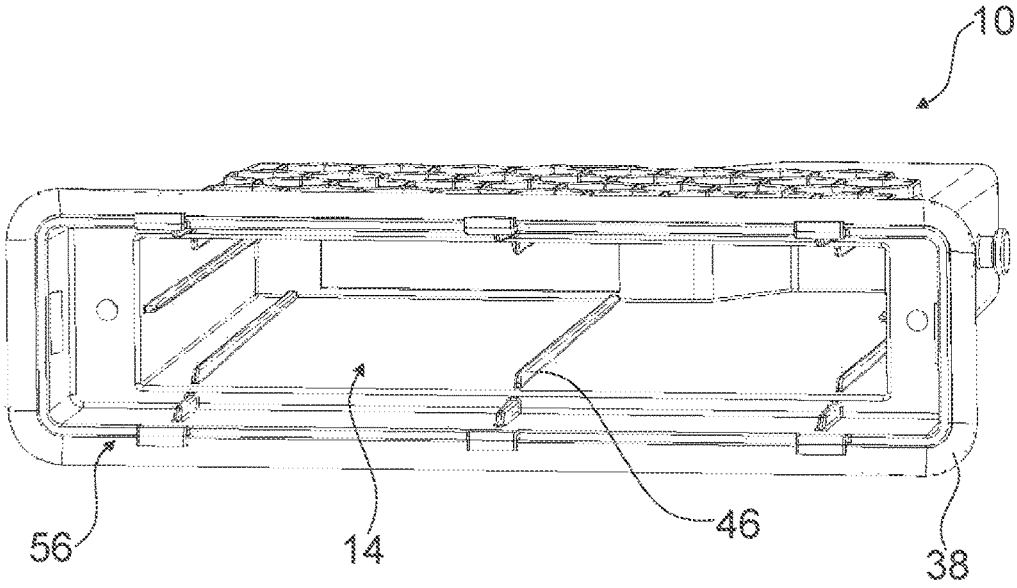

FIGS. 1 and 2 show a perspective view of an exemplary home appliance 18 comprising a home appliance device. In the present case, the home appliance 18 is implemented as a home chiller appliance, in particular as a refrigerator-freezer combination. Alternatively, a home appliance could be embodied as any other kind of home chiller appliance, like a refrigerator, a freezer and/or a wine-cooler. In addition, a home appliance could also be embodied as a home appliance for warming and in particular for cooking victuals, e.g. an oven, a steamer and/or a microwave.

The home appliance 18 is configured for cooling victuals. For this purpose, the home appliance device comprises a home appliance housing 20. The home appliance housing 20 comprises an inner liner 22 and several side walls 24. In addition, the home appliance housing 20 comprises a front frame 26 which in particular encompasses the inner liner 22 and is preferably implemented of metal. The home appliance housing 20 defines a storage space 28, in particular for storing and tempering the victuals. In the present case, the storage space 28 is delimited by the inner liner 22. Moreover, the home appliance housing 20 defines an insulation-receiving chamber 12. The insulation-receiving chamber 12 is spatially separated from the storage space 28. The insulation-receiving chamber 12 is delimited by the inner liner 22, the side walls 24 and the front frame 26.

The home appliance device further comprises at least one home appliance door 30. The home appliance door 30 is movably connected to the home appliance housing 20. In the present case, the home appliance door 30 is pivotally connected to the home appliance housing 20. The home appliance door 30 is pivotable about a pivot axis 32 which is perpendicular to a base, a ground and/or a floor space of the home appliance 18. In a closed state, the home appliance door 30 closes off the home appliance housing 20, in particular the storage space 28, at least partly. For completely closing off and in particular sealing off the storage space 28, the home appliance device comprises a further home appliance door, which for reasons of clarity and comprehensibility no reference number is given to. Alternatively, a home appliance door could be pivotable about a pivot axis which is parallel to a base, a ground and/or a floor space of a home appliance. Moreover, a home appliance door may be connected to a housing in a linearly movable manner and/or in a push-pull manner. In addition, it is conceivable that a home appliance device may comprise exactly one home appliance door.

Moreover, the home appliance device comprises a functional unit 16. In the present case, the functional unit 16 is implemented as a door opening assistance unit. The functional unit 16 is integrated in the home appliance housing 20. The functional unit 16 is arranged above the storage space 28 and/or at a side of the home appliance 18 which faces away from the base, the ground and/or the floor space of the home appliance 18. The functional unit 16 is configured for reducing an opening force required for opening the home appliance door 30.

For this purpose the functional unit 16 comprises at least one, in the present case in particular exactly one, functional element 34. The functional element 34 is implemented as an actuation element. The functional element 34 is movable in a direction which is at least substantially perpendicular to a main extension plane of the home appliance housing 20. The functional element 34 contacts the home appliance door 30 and in particular transfers an actuation force to the home appliance door 30 in at least one operational state, in particular such that an opening force is reduced. Alternatively, a functional unit may be implemented as a lighting unit and/or a ventilation unit.

The home appliance device further comprises at least one functional housing 10. In the present case, the home appliance device comprises exactly one functional housing 10. FIGS. 3*a* to 3*e* show the functional housing 10 in different perspective views.

The functional housing 10 is implemented integrally. The functional housing 10 is implemented of plastic. The functional housing 10 is implemented separately from the home appliance housing 20. The functional housing 10 is integrated in the home appliance housing 20. The functional housing 10 is arranged at least largely within the insulation-receiving chamber 12. In an assembled state, the functional housing 10 is connected to the home appliance housing 20, in the present case in particular to the front frame 26. The functional housing 10 is in the assembled state arranged above the storage space 28 and/or at a side of the home appliance 18 which faces away from the base, the ground and/or the floor space of the home appliance 18.

Moreover, the functional housing 10 is configured for receiving the functional unit 16. For this purpose, the functional housing 10 defines a receiving space 14, which in particular has a first receiving opening, for receiving the functional unit 16. In addition, the front frame 26 defines an aperture 35 which coincides with the receiving space 14 and in particular the first receiving opening. In the assembled state, the functional housing 10 is arranged such that the receiving space 14 is fully accessible from an outside of the home appliance 18. Thereby, the first receiving opening is arranged at least substantially parallel to the main extension plane of the home appliance housing 20.

The functional housing 10 comprises a base body 36. The base body 36 delimits the receiving space 14. The base body 36 is at least substantially cup-shaped and/or dome-shaped. The base body 36 comprises a circumferential collar 38 encompassing the first receiving opening and in particular facing the front frame 26 in an assembled state. In an operational state, the base body 36 is surrounded by insulation material, in the present case in particular foam insulation.

Furthermore, the functional housing 10 is self-supporting and at least substantially maintains a shape during a foaming process of the insulation-receiving chamber 12. For this purpose, the functional housing 10 comprises a reinforcement feature 40. The reinforcement feature 40 is implemented as a structural unit. The reinforcement feature 40 extends over less than 50% and preferably less than 40% of a surface of the base body 36. Herein, the reinforcement feature 40 covers merely a portion of an exterior side of the functional housing 10. The reinforcement feature 40 is configured to strengthen the functional housing 10 and thus to increase a mechanical stability of the functional housing 10, in particular against a pressure of the insulation material at least during the foaming process of the insulation-receiving chamber 12.

The reinforcement feature 40 comprises at least one reinforcement element 42, 44, 46. In the present case the reinforcement feature 40 comprises several reinforcement elements 42, 44, 46.

A first reinforcement element 42 of the reinforcement elements 42, 44, 46 is arranged outside the receiving space 14. The first reinforcement element 42 is arranged on an upper exterior side of the base body 36 with respect to the storage space 28 and/or the base, the ground and/or the floor space of the home appliance 18. The first reinforcement element 42 extends over less than 85% of the upper exterior side of the base body 36. The first reinforcement element 42 is honeycomb-shaped.

A second reinforcement element 44 of the reinforcement elements 42, 44, 46 is arranged outside the receiving space 14. The second reinforcement element 44 is arranged on a lower exterior side of the base body 36 with respect to the storage space 28 and/or the base, the ground and/or the floor space of the home appliance 18. The second reinforcement element 44 extends over less than 40% of the lower exterior side of the base body 36. The second reinforcement element 44 is honeycomb-shaped.

A third reinforcement element 46 of the reinforcement elements 42, 44, 46 is arranged within the receiving space 14. The third reinforcement element 46 is arranged on an inner side of the base body 36 which in particular delimits the receiving space 14. The third reinforcement element 46 is rib-shaped. Thus the reinforcement feature 40 comprises at least two reinforcement elements 42, 44, 46 which are shaped differently. The third reinforcement element 46 extends in a direction which is at least substantially perpendicular to the first receiving opening.

In addition, the reinforcement feature 40 comprises several further reinforcement elements, in the present case in particular at least seven further reinforcement elements, which are shaped identically to the third reinforcement element 46, which are arranged within the receiving space 14 and which are distributed over the receiving space 14. Alternatively, a reinforcement feature may comprise merely one reinforcement element and/or merely identically shaped reinforcement elements. Furthermore, a reinforcement feature may comprise at least four, at least eight and/or at least twelve reinforcement elements which in particular may be shaped differently. Moreover, it is conceivable that a reinforcement feature comprises merely one reinforcement element arranged within a receiving space or arranged outside the receiving space.

In addition, the functional housing 10 defines a further receiving space 50, which in particular has a second receiving opening for receiving an electrical socket 52 of the home appliance device, which is in particular configured for supplying the functional unit 16 with power, and has a third receiving opening for receiving electrical connection elements like a cabling or similar (not shown). The further receiving space 50 is smaller than the receiving space 14 by at least 60%. The further receiving space 50 is located at a side of the base body 36 which faces away from the first receiving opening and/or from the front frame 26 at least in an assembled state. Herein, the second receiving opening is arranged at least substantially parallel to the main extension plane of the home appliance housing 20. The third receiving opening is arranged at least substantially perpendicularly to the main extension plane of the home appliance housing 20. The third receiving opening is arranged at least substantially perpendicularly to the second receiving opening. Alternatively, a further receiving space may have exactly one receiving opening, in particular a second receiving opening or a third receiving opening. Furthermore, it is conceivable to change a functionality of the receiving openings.

Furthermore, the functional housing 10 comprises a sealing unit 54. The sealing unit 54 is implemented integrally with the base body 36. In the present case, the sealing unit is implemented as a gap seal and/or a chamber seal. The sealing unit 54 is allocated to the third receiving opening. The sealing unit 54 is configured for sealing off the third receiving opening in particular during the foaming process. Alternatively, a sealing unit may be implemented as a rubber seal and/or a labyrinth seal. Moreover, it is conceivable to implement a sealing unit separately from a base body.

Figure 4A:
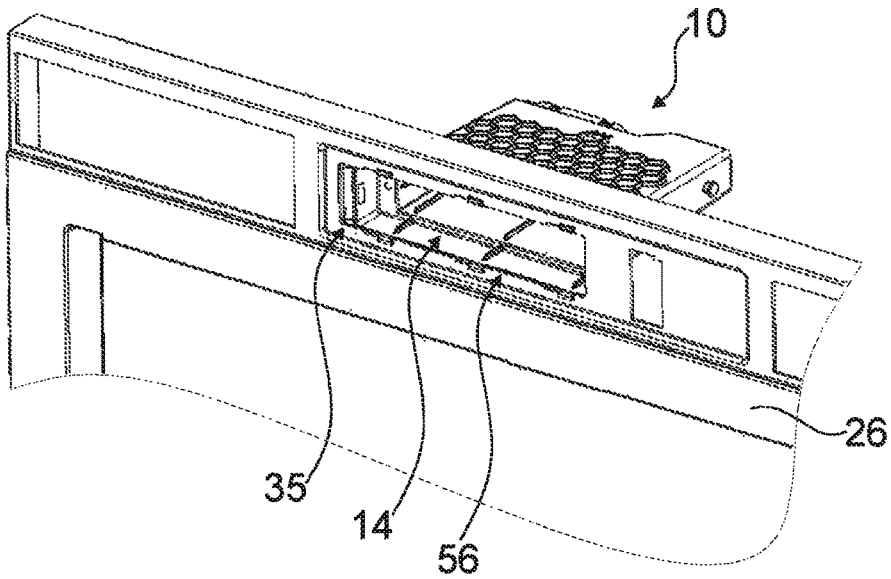
Figure 4B:
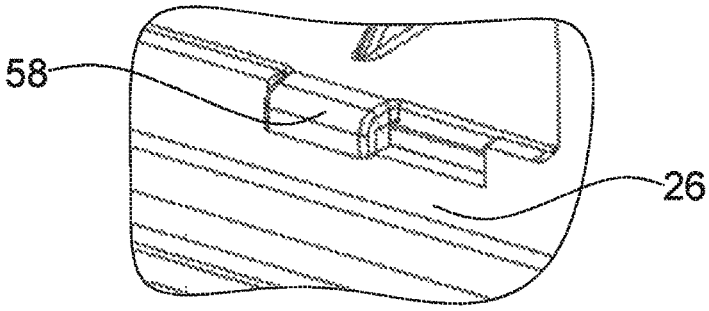
Figure 5:
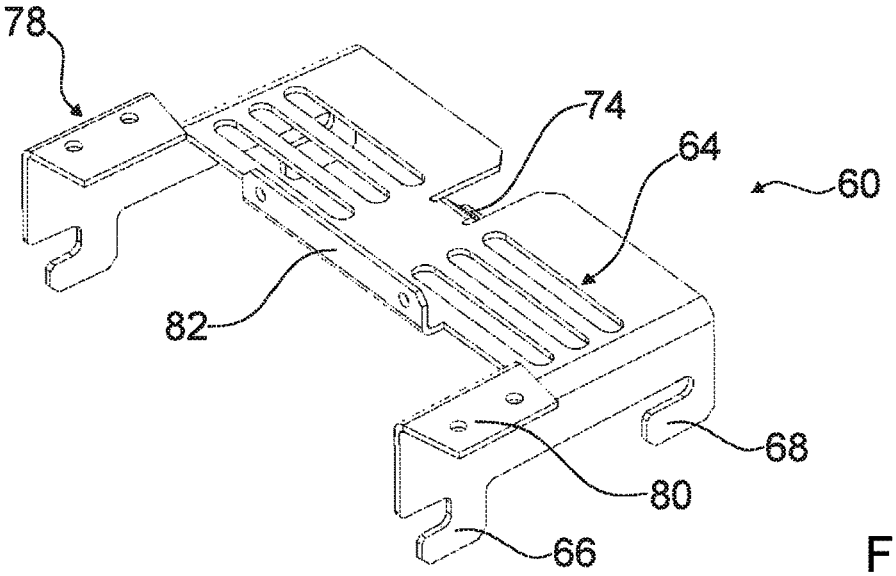

Besides, the functional housing 10 comprises a first fastening unit 56 (see also FIGS. 4*a* and 4*b*). The first fastening unit 56 is located at a side of the base body 36 which faces the first receiving opening and/or the front frame 26 at least in an assembled state. The first fastening unit 56 is configured to fasten the functional housing 10 to the home appliance housing 20. Herein, the first fastening unit 56 is configured to detachably connect the base body 36 to the front frame 26. In the present case, the first fastening unit 56 cooperates with the circumferential collar 38 for fastening the functional housing 10 to the home appliance housing 20.

The first fastening unit 56 comprises a least one first fastening element 58. In the present case, the first fastening unit 56 comprises several, in particular six, first fastening elements 58. The first fastening elements 58 are implemented identically. The first fastening elements 58 are circumferentially distributed over the first receiving opening. The first fastening elements 58 are hook-shaped. The first fastening elements 58 are configured to bear against the front frame 26.

In the present case, the first fastening unit 56 is implemented in such a way that for mounting the functional housing 10 to the home appliance housing 20, the functional housing 10 is moved in two directions which are at least substantially perpendicular with respect to each other. Herein, the functional housing 10 is first moved with respect to the home appliance housing 20 in a first direction which is at least substantially perpendicular to the main extension plane of the home appliance housing 20, and is then moved with respect to the home appliance housing 20 in a second direction which is at least substantially parallel to the main extension plane of the home appliance housing 20. Thus the functional housing 10 is mounted to the home appliance housing 20 in a mounting direction which is parallel to the main extension plane of the home appliance housing 20. Alternatively, a first fastening unit may comprise merely one first fastening element and/or at least two differently shaped first fastening elements. Furthermore, a first fastening unit may comprise at least four, at least eight or at least twelve first fastening elements. Moreover, it is conceivable that a first fastening unit is self-supporting in particular such that the first fastening unit refrains from cooperating with a circumferential collar. Moreover, a first fastening unit may be implemented separately from a base body.

The home appliance device further comprises at least one attachment element 60, 62. In the present case, the home appliance device comprises two attachment elements 60, 62. A first attachment element 60 of the attachment elements 60, 62 is shown in FIGS. 5 to 8 while a second attachment element 62 of the attachment elements 60, 62 is shown in FIGS. 9*a* to 10*c*.

The first attachment element 60 is implemented as a supporting frame and configured for supporting the functional housing 10. The first attachment element 60 is implemented integrally. The first attachment element 60 is at least substantially U-shaped. The first attachment element 60 is implemented of metal, in the present case in particular of steel. The first attachment element 60 has at least one recess 64, in the present case at least six recesses, for a pass-through of insulation material. The first attachment element 60 is implemented separately from the functional housing 10. Moreover, the first attachment element 60 is implemented separately from the home appliance housing 20. The first attachment element 60 is integrated in the home appliance housing 20. The first attachment element 60 is arranged at least largely within the insulation-receiving chamber 12.

In an assembled state, the first attachment element 60 is connected to the functional housing 10. The first attachment element 60 is in the assembled state detachably connected to the functional housing 20, in particular in a form-fit and/or force-fit manner. In the present case, the first attachment element 60 is connected to the functional housing 10 by at least one clamping connection and at least one snap-fit connection. Moreover, in the assembled state the first attachment element 60 is arranged above the functional housing 10 with respect to the base, the ground and/or the floor space of the home appliance 18. The first attachment element 60 contacts the upper exterior side of the base body 36. In the present case, the first attachment element 60 at least largely encompasses the functional housing 10 in a circumferential direction in the assembled state. The first attachment element 60 extends over less than 50% and preferably less than 40% of the surface of the base body 36. Alternatively, a first attachment element may be implemented in several parts. Moreover, a first attachment element may be implemented of plastic. In addition, it is conceivable that a first attachment element encompasses a functional housing completely.

For the purpose of connecting the first attachment element 60 to the functional housing 10, the first attachment element 60 comprises at least one holding element 66, 68. In the present case, the first attachment element 60 comprises several holding elements 66, 68.

A first holding element 66 of the holding elements 66, 68 is located at a first lateral side of the first attachment element 60. The first holding element 66 is located at a side of the first attachment element 60 which faces the front frame 26 at least in an assembled state. The first holding element 66 is at least substantially hook-shaped. The first holding element 66 defines a holding recess. The first holding element 66 is configured to cooperate with a further first holding element 70, in particular a holding pin, of the functional housing 10.

A second holding element 68 of the holding elements 66, 68 is located at the first lateral side of the first attachment element 60. The second holding element 68 is offset with respect to the first holding element 66, in particular in a direction which is at least substantially perpendicular to the first receiving opening of the receiving space 14. The second holding element 68 is located at a side of the first attachment element 60 which faces away from the front frame 26 at least in an assembled state. The second holding element 68 is at least substantially hook-shaped. The second holding element 68 defines a holding recess. The second holding element 68 is configured to cooperate with a further second holding element 72, in particular a holding pin, of the functional housing 10.

In addition, the first attachment element 60 comprises two further holding elements, which are implemented identically to the first holding element 66 and the second holding element 68 and which are arranged at a second lateral side of the first attachment element 60. Alternatively, a first attachment element may comprise merely one holding element and/or two holding elements and/or six holding elements.

In addition, the first attachment element 60 comprises at least one resilient element 74, in particular for the purpose of connecting the first attachment element 60 to the functional housing 10. In the present case, the first attachment element 60 comprises exactly one resilient element 74.

The resilient element 74 is located at a top side of the first attachment element 60, which is in particular at least substantial perpendicular to the first lateral side and the second lateral side of the first attachment element 60. The resilient element 74 is located in a central region of the top side of the first attachment element 60. The resilient element 74 is located at a side of the first attachment element 60 which faces away from the front frame 26 at least in an assembled state. The resilient element 74 is implemented as a resilient arm. The resilient element 74 is configured to cooperate with an, in particular ramp-shaped, connection element 76 of the functional housing 10 (see FIG. 7*c*). Alternatively, a first attachment element may comprise at least two and/or at least three resilient elements. Moreover, it is conceivable to refrain from using a resilient element.

Figure 6A:
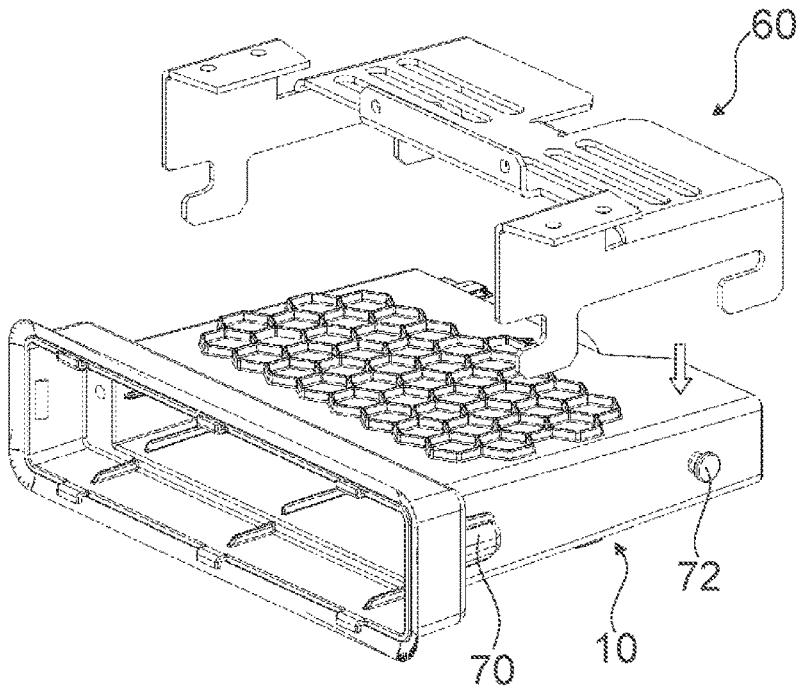
Figure 6B:
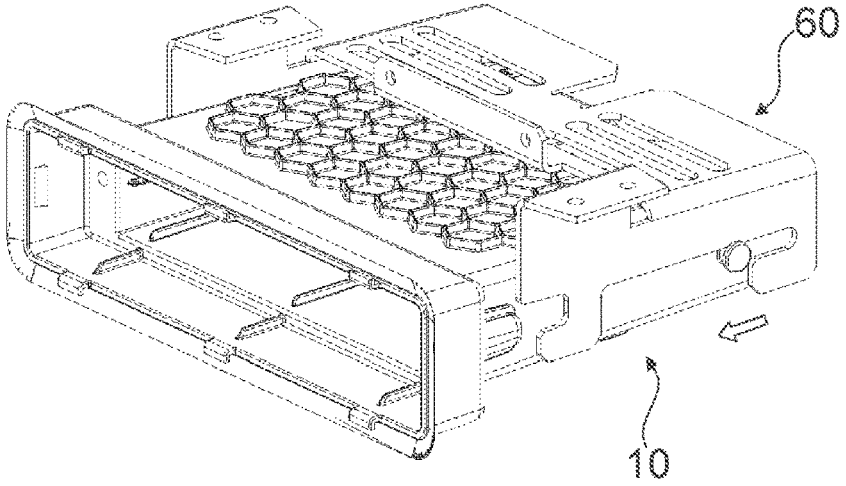
Figure 7A:
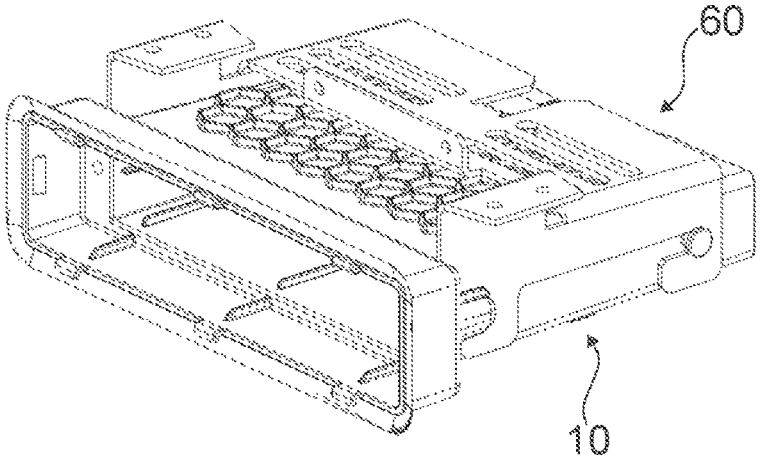
Figure 7B:
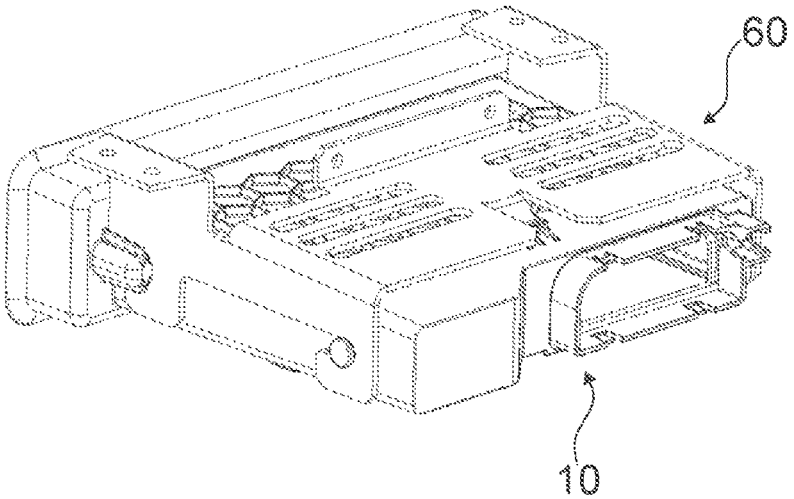
Figure 7C:
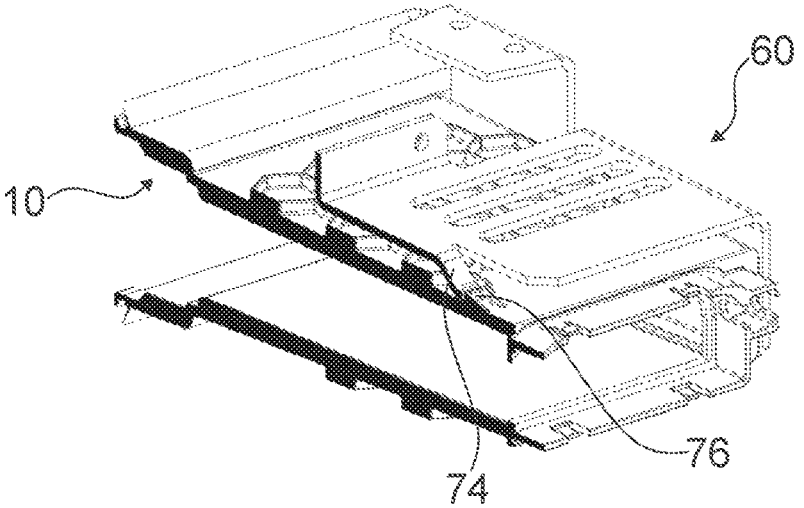
Figure 8:
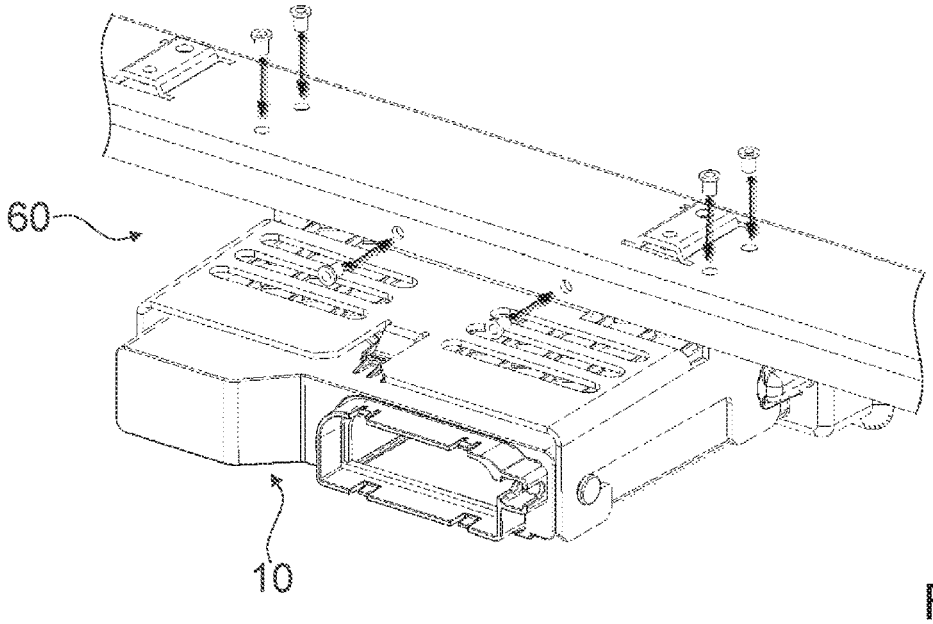
Figure 9A:
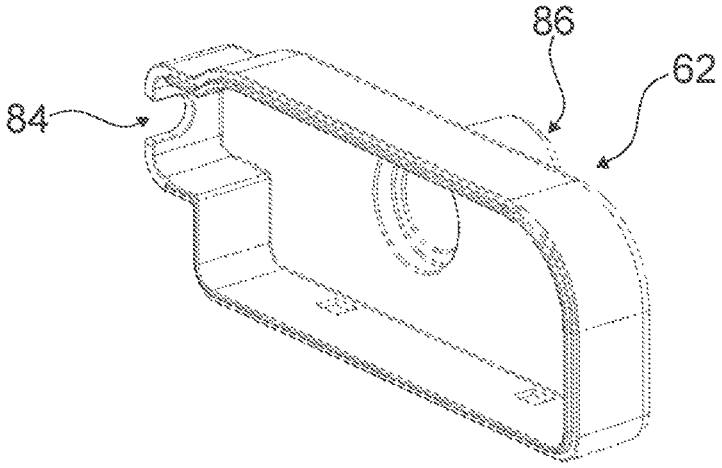
Figure 9B:
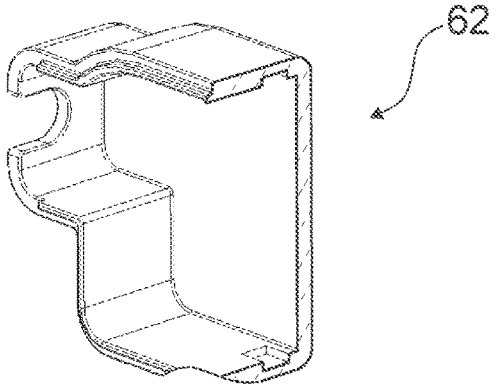
Figure 10A:
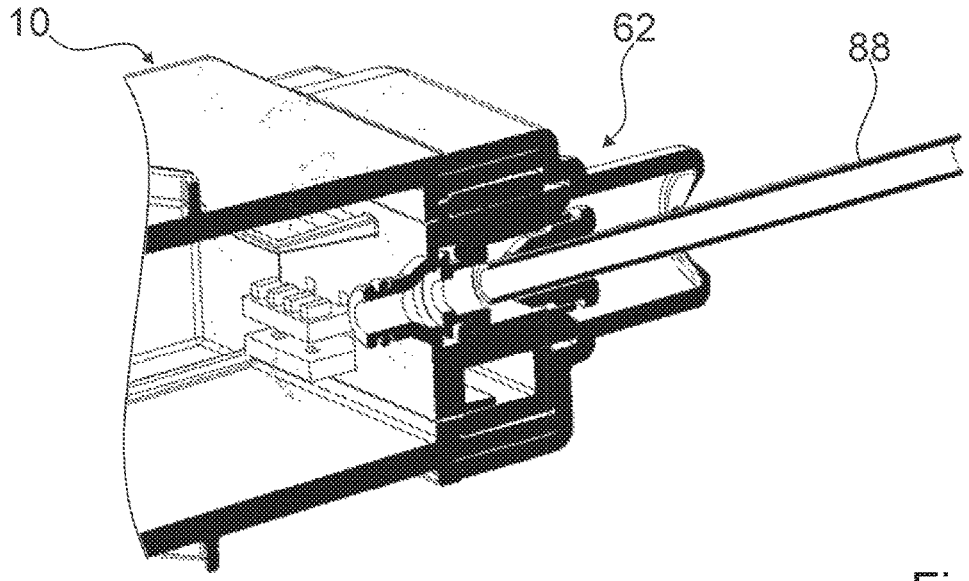
Figure 10B:
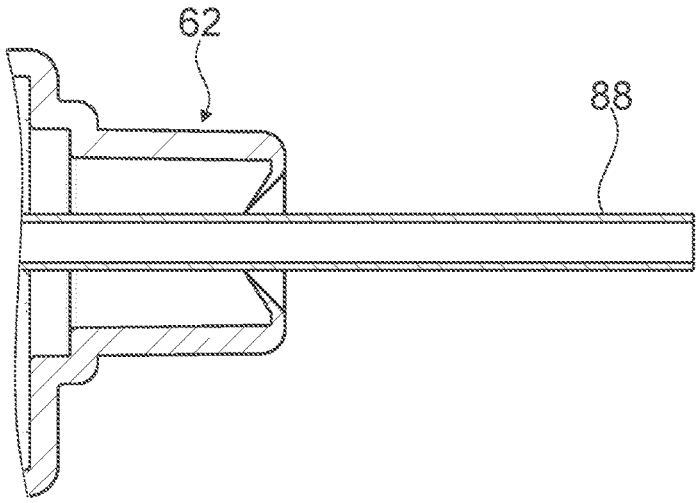
Figure 10C:
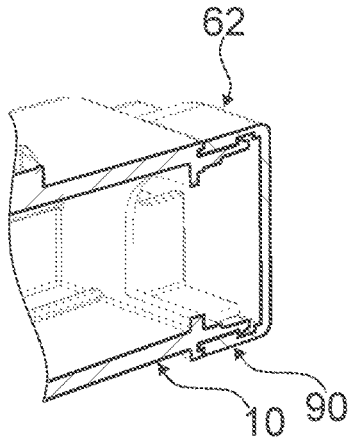

In the present case, the first attachment element 60 is implemented in such a way that for mounting the first attachment element 60 to the functional housing 10, the first attachment element 60 is moved in two directions which are at least substantially perpendicular with respect to each other (see in particular FIGS. 6*a* and 6*b*). Herein, the first attachment element 60 is first moved with respect to the functional housing 10 in a first direction which is at least substantially perpendicular to the base, the ground and/or the floor space of the home appliance 18, and is then moved with respect to the functional housing 10 in a second direction, which is at least substantially perpendicular to the first receiving opening of the receiving space 14. Thus the first attachment element 60 is mounted to the functional housing 10 in a mounting direction which is at least substantially perpendicular to the receiving opening of the receiving space 14.

Moreover, the first attachment element 60 comprises a second fastening unit 78. The second fastening unit 78 is located at a side of the first attachment element 60 which faces the front frame 26 at least in an assembled state (see also FIG. 8). The second fastening unit 78 is configured to fasten the first attachment element 60 directly and in particular the functional housing 10 indirectly to the home appliance housing 20. Herein, the second fastening unit 78 is configured to detachably connect the first attachment element 60 to the front frame 26, in particular to a horizontal plate-shaped region of the front frame 26. In the present case, the second fastening unit 78 is configured for connecting the first attachment element 60 to the front frame 26 by a screw connection.

The second fastening unit 78 comprises a least one second fastening element 80, 82. In the present case, the second fastening unit 78 comprises several, in particular at least three, second fastening elements 80, 82. Thus at least two of the second fastening elements 80, 82 are implemented differently.

One second fastening element 80 of the second fastening elements 80, 82 protrudes from the first lateral side of the first attachment element 60. The second fastening element 80 is at least substantially parallel to the top side of the first attachment element 60. The second fastening element 80 has at least two threaded holes in particular for connecting the first attachment element 60 to the front frame 26.

Another second fastening element 82 of the second fastening elements 80, 82 protrudes from the top side of the first attachment element 60. The other second fastening element 82 is oriented at least substantially perpendicular to the top side of the first attachment element 60 and to the first lateral side of the first attachment element 60. The other second fastening element 82 has at least two threaded holes in particular for connecting the first attachment element 60 to the front frame 26.

A further second fastening element of the second fastening elements 80, 82 is implemented identically to the second fastening element 80 and is located at the second lateral side of the first attachment element 60.

In the present case, the second fastening unit 78 is implemented in such a way that for mounting the first attachment element 60 to the home appliance housing 20, the first attachment element 60 is moved in two directions which are at least substantially perpendicular with respect to each other. Herein, the first attachment element 60 is first moved with respect to the home appliance housing 20 in a first direction, which is at least substantially perpendicular to the base, the ground and/or the floor space of the home appliance 18, and is then moved with respect to the home appliance housing 20 in a second direction, which is at least substantially perpendicular to the main extension plane of the home appliance housing 20. Alternatively, a second fastening unit may comprise merely one second fastening element and/or at least four second fastening elements. Moreover, a second fastening unit may be implemented separately from a first attachment element.

The second attachment element 62 is implemented as a cover for electronics and configured for covering the electrical socket 52. The second attachment element 62 is implemented integrally. The second attachment element 62 is implemented of plastic. The second attachment element 62 has at least one further recess 84, 86, in the present case at least two recesses 84, 86, for receiving the electrical connection elements like the cabling (not shown), and for receiving pneumatically connection elements 88, like a hose. The second attachment element 62 is implemented separately from the functional housing 10. The second attachment element 62 is implemented separately from the first attachment element 60. Moreover, the second attachment element 62 is implemented separately from the home appliance housing 20. The second attachment element 62 is integrated in the home appliance housing 20. The second attachment element 62 is arranged at least largely within the insulation-receiving chamber 12.

In an assembled state, the second attachment element 62 is connected to the functional housing 10. The second attachment element 62 is in the assembled state detachably connected to the functional housing 10, in particular in a form-fit and/or force-fit manner. In the present case, the second attachment element 62 is connected to the functional housing 10 by at least one snap-fit connection 90 (see FIG. 10*c*). Moreover, in the assembled state the second attachment element 62 covers the further receiving space 50 and in particular the electrical socket 52. Thus the second attachment element 62 seals off the further receiving space 50, in particular during the foaming process, by a labyrinth seal. In the present case, the second attachment element 62 completely encompasses the functional housing 10 in a circumferential direction in the assembled state.

In the present case, the second attachment element 62 is implemented in such a way that for mounting the second attachment element 62 to the functional housing 10, the second attachment element 62 is moved in a direction which is at least substantially perpendicular to the main extension plane of the home appliance housing 20. Therefore, the second attachment element 62 is mounted to the functional housing 10 in a mounting direction which is at least substantially perpendicular to the receiving opening of the receiving space 14. Alternatively, a second attachment element may be implemented in several parts. Moreover, a second attachment element may be implemented of metal. In addition, it is conceivable that a second attachment element encompasses a functional housing merely largely.

Figure 11A:
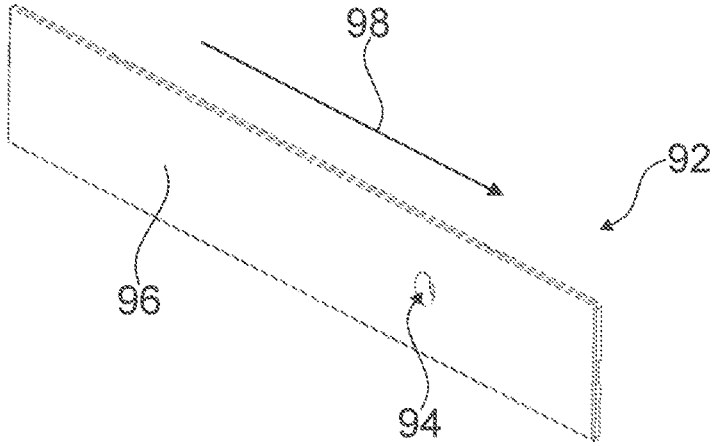

The home appliance device further comprises at least one front cover element 92. In the present case, the home appliance device comprises exactly one front cover element 92. The front cover element 92 is shown in FIGS. 11*a* to 12.

The front cover element 92 is implemented integrally. The front cover element 92 is at least substantially panel-shaped. The front cover element 92 is implemented of plastic. Furthermore, the front cover element 92 is implemented separately from the functional housing 10. The front cover element 92 is implemented separately from the home appliance housing 20. Moreover, the front cover element 92 is implemented separately from the home appliance door 30. The front cover element 92 is arranged between the home appliance housing 20 and the home appliance door 30. Alternatively, a front cover element may be implemented in several parts. Moreover, a front cover element may be implemented of metal.

In an assembled state, the front cover element 92 is connected to the home appliance housing 20, in the present case in particular to the front frame 26. The front cover element 92 is in the assembled state detachably connected to the front frame 26, in particular in a form-fit and/or force-fit manner. In the present case, the front cover element 92 is not connected to the functional housing 10 and/or the functional unit 16. The front cover element 92 is configured for covering the receiving space 14 and in particular the receiving opening of the receiving space 14 at least largely and/or the aperture 35 of the front frame 26 at least largely.

The front cover element 92 has at least one, in the present case exactly one, opening 94, for a pass-through of the functional element 34 of the functional unit 16. The opening 94 has a circular shape. The opening 94 is offset with respect to a geometric center of the front cover element 92 at least if viewed in a direction which is at least substantially perpendicular to a main extension plane of the front cover element 92. Alternatively, a front cover element may comprise at least two and/or at least four openings. Moreover, an opening can be located in a central region of a front cover element.

In addition, the front cover element 92 has, in at least one direction 98, an extension which exceeds an extension of the receiving space 14 in said direction 98 by at least 30%. In the present case, the direction 98 is a longitudinal direction of the front cover element 92. Herein, the front cover element 92 is offset with respect to the receiving space 14 at least if viewed in a direction which is at least substantially perpendicular to a main extension plane of the front cover element 92. In the present case, the front cover element 92 is configured for covering the receiving space 14 and at least one further component, in the present case in particular installation parts.

For this purpose, the front cover element 92 comprises a front panel 96. The front panel 96 is rectangular. The front panel 96 defines a main part of the front cover element 92. Alternatively, it is conceivable that a front panel may be circular and/or oval.

Figure 11B:
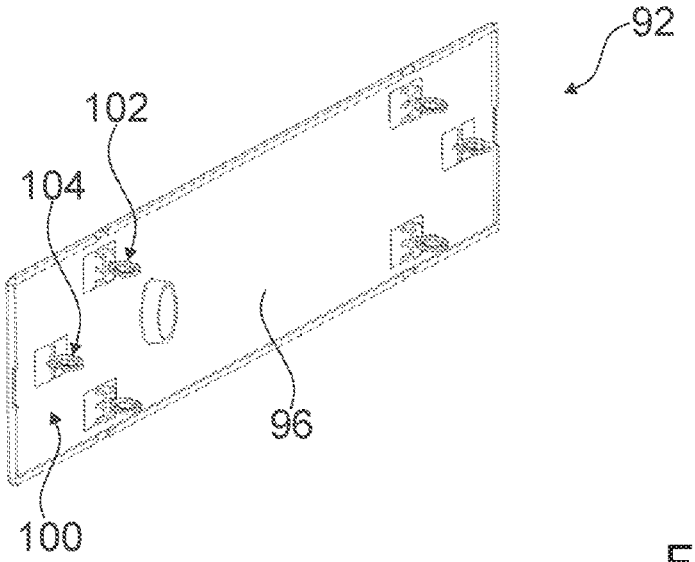
Figure 12:
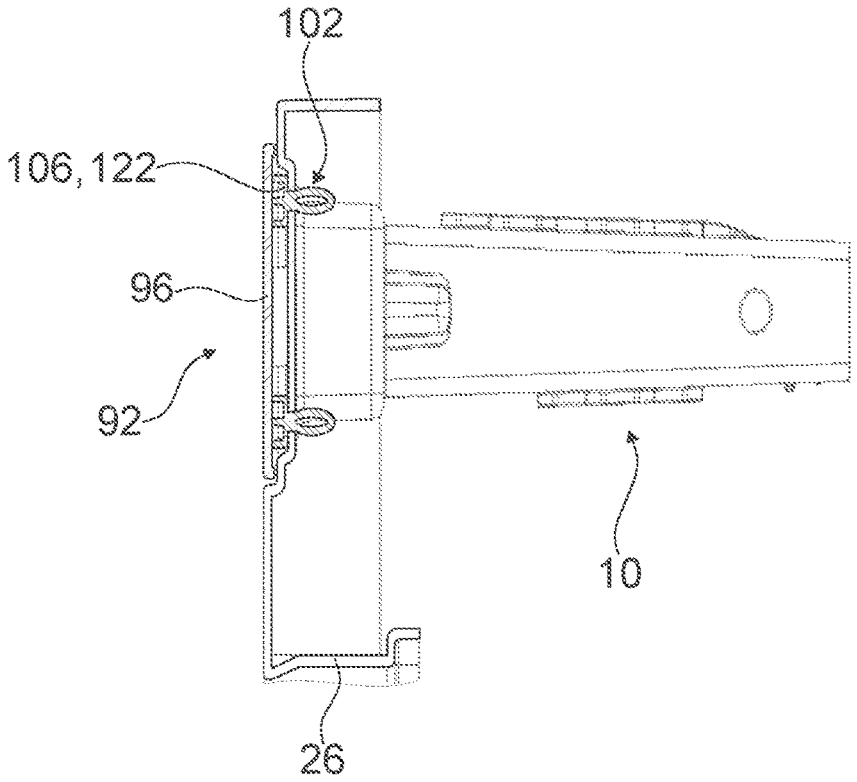

For the purpose of connecting the front cover element 92 to the home appliance housing 20, the front cover element 92 comprises a third fastening unit 100 (see FIG. 11*b*). The third fastening unit 100 is located at a side of the front panel 96 which faces the front frame 26 at least in an assembled state. The third fastening unit 100 is configured to fasten the front panel 96 to the home appliance housing 20. Herein, the third fastening unit 100 is configured to detachably connect the front panel 96 to the front frame 26. In the present case, the third fastening unit 100 is configured to connect the front panel 96 to the front frame 26 by a snap-fit connection.

The third fastening unit 100 comprises a least one third fastening element 102, 104. In the present case, the third fastening unit 100 comprises several, in particular at least six, third fastening elements 102, 104. Herein, the third fastening elements 102, 104 are merely located in a peripheral region of the front panel 96. Hence, a central region of the front panel 96 is free from third fastening elements 102, 104. Moreover, at least two of the third fastening elements 102, 104 are implemented differently from each other.

Figure 11C:
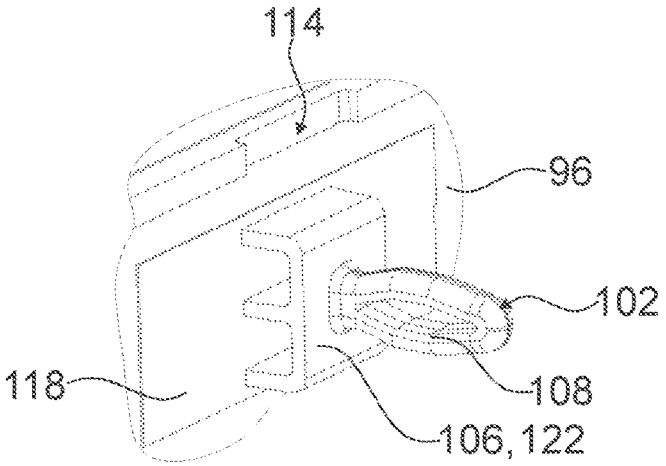

One third fastening element 102 of the third fastening elements 102, 104 is located in a close vicinity of a longitudinal side wall of the front cover element 92 (see also FIG. 11*c*). The third fastening element 102 protrudes from the front panel 96 in a direction which is at least substantially perpendicular to the main extension plane of the front cover element 92. The third fastening element 102 is implemented as a snap-fit element. The third fastening element 102 comprises an, in particular at least substantially rectangular-cuboid-shaped, base portion 106 and an, in particular annular and/or circumferentially closed, fastening portion 108.

Figure 11D:
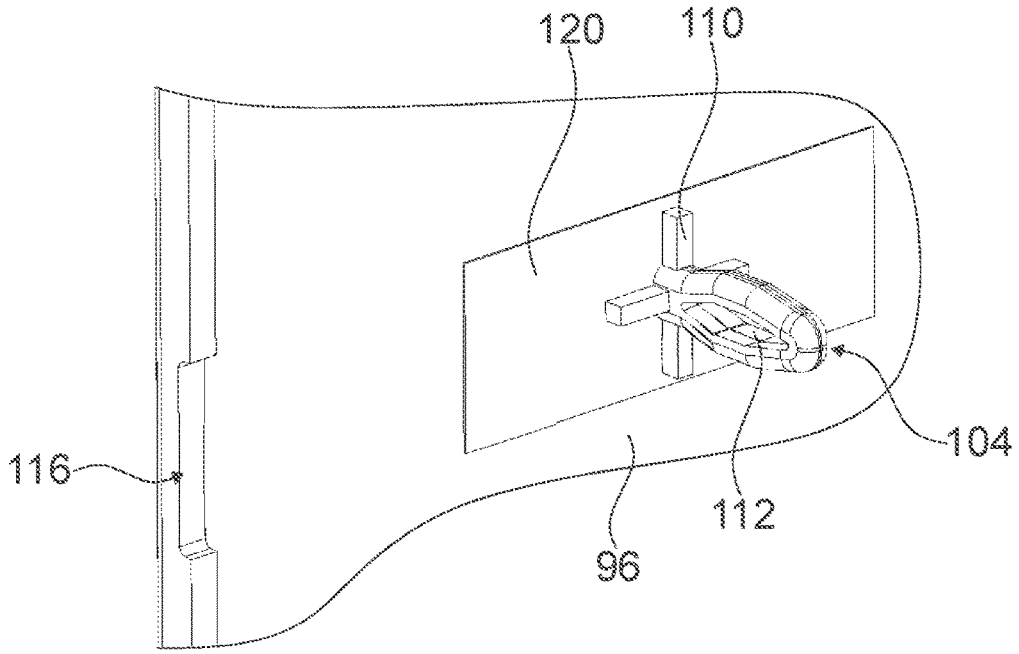

Another third fastening element 104 of the third fastening elements 102, 104 is located in a close vicinity of a lateral side wall of the front cover element 92 (see also FIG. 11*d*). The other third fastening element 104 protrudes from the front panel 96 in a direction which is at least substantially perpendicular to the main extension plane of the front cover element 92. The other third fastening element 104 is implemented as a snap-fit element. The other third fastening element 104 comprises an, in particular at least substantially cross-shaped, further base portion 110 and an, in particular annular and/or circumferentially closed, further fastening portion 112.

Further third fastening elements of the third fastening elements 102, 104 are implemented identically to the third fastening element 102 and/or the other third fastening element 104 and are distributed over the front panel 96.

In the present case, the front cover element 92 is implemented in such a way that for mounting the front cover element 92 to the front frame 26, the front cover element 92 is moved in a direction which is at least substantially perpendicular to the main extension plane of the home appliance housing 20. Therefore, the front cover element 92 is mounted to the home appliance housing 20 in a mounting direction which is at least substantially perpendicular to the receiving opening of the receiving space 14. Alternatively, a third fastening unit may comprise merely one third fastening element and/or at least four third fastening elements. Moreover, a third fastening unit may be implemented separately from a front cover element.

In addition, the front cover element 92 has at least one depression 114, 116. In the present case, the front cover element 92 has several depressions 114, 116. A number of depressions 114, 116 is equal to a number of third fastening elements 102, 104. In the present case, each depression 114, 116 is allocated to one of the third fastening elements 102, 104. The depressions 114, 116 are configured for detaching the front cover element 92 from the front frame 26, in particular by merely using simple tools like a screwdriver (not shown).

For this reason, protective sheets 118, 120 are affixed to the front panel 96 and allocated to each of the third fastening elements 102, 104. The protective sheets 118, 120 are configured for preventing a scratching of the front panel 96. Alternatively, a number of depressions and a number of third fastening elements may differ. Moreover, it is conceivable to refrain from using protective sheets and/or to use exactly one protective sheet and/or a protective coating instead of protective sheets.

Furthermore, the front cover element 92 comprises at least one spacer element 122. The spacer element 122 is at least substantially rectangular-cuboid-shaped. The spacer element 122 is configured for supporting the front panel 96. The spacer element 122 is configured for preventing sink marks. For this purpose, the spacer element 122 bears against the home appliance housing 20 and in particular the front frame 26. In the present case, the spacer element 122 is implemented integrally with the third fastening element 102 and in particular formed by the base portion 106 of the third fastening element 102. Alternatively, a spacer element may be implemented separately from a third fastening element. Moreover, it is conceivable to refrain from using a spacer element.

Figure 13:
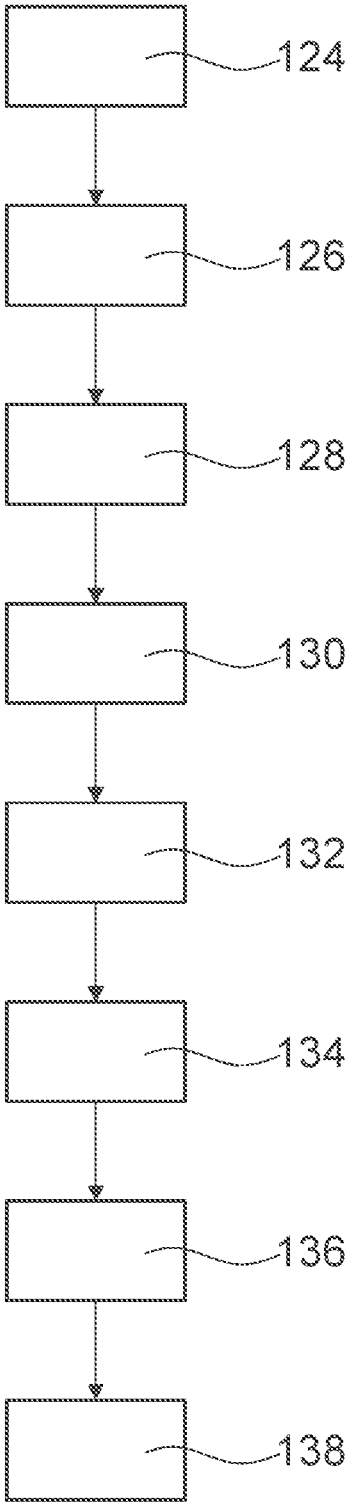

A method for assembling the home appliance device is shown in FIG. 13 and comprises the following steps:

In a first step 124, the first attachment element 60 is connected to the functional housing 10. In a second step 126, the functional housing 10 is connected to the front frame 26, in particular via the first fastening unit 56. In a third step 128, the first attachment element 60 is connected to the front frame 26, in particular via the second fastening unit 78. In a fourth step 130, the electrical socket 52 is inserted into the further receiving space 50. In a fifth step 132, the second attachment element 62 is connected to the functional housing 10. In a sixth step 134, the home appliance housing 20 is assembled and the insulation-receiving chamber 12 is filled with the insulation material, in particular foam insulation. In a seventh step 136, the functional unit 16 is inserted into the receiving space 14. Finally, in an eighth step 138, the front cover element 92 is connected to the front frame 26, in particular via the third fastening unit 100.

The following is a summary list of reference numerals and the corresponding structure used in the above description of the invention:

10 functional housing
12 insulation-receiving chamber
14 receiving space
16 functional unit
18 home appliance
20 home appliance housing
22 inner liner
24 side wall
26 front frame
28 storage space
30 home appliance door
32 pivot axis
34 functional element
35 aperture
36 base body
38 circumferential collar
40 reinforcement feature
42 reinforcement element
44 reinforcement element
46 reinforcement element
50 receiving space
52 electrical socket
54 sealing unit
56 fastening unit
58 fastening element
60 attachment element
62 attachment element
64 recess
66 holding element
68 holding element
70 holding element
72 holding element
74 resilient element
76 connection element
78 fastening unit
80 fastening element
82 fastening element
84 recess
86 recess
88 connection element
90 snap-fit connection
92 front cover element
94 opening
96 front panel
98 direction
100 fastening unit
102 fastening element
104 fastening element
106 base portion
108 fastening portion
110 base portion
112 fastening portion
114 depression
116 depression
118 protective sheet
120 protective sheet
122 spacer element
124 step
126 step
128 step
130 step
132 step
134 step
136 step
138 step

The invention claimed is:

1. A home appliance device comprising:

at least one functional housing, which is arranged at least largely within an insulation-receiving chamber and defines at least one receiving space for receiving at least one functional unit; and at least one front cover element covering said receiving space, said front cover element formed with an opening;

said functional housing having at least two protruding holding elements which protrude horizontally from opposite sides of said functional housing, perpendicular to a direction of insertion of said functional housing;

said functional housing having at least one ramp-shaped connection element, separate from said at least two protruding holding elements;

at least one attachment element which at least partly encompasses the functional housing in an assembled state;

said at least one attachment element having at least two holding elements formed with a recess extending in the direction of insertion of said functional housing and configured to receive said at least two protruding holding elements and vertically secure said functional housing; and said at least one attachment element having at least one resilient arm element configured to engage said at least one ramp-shaped connection element and secure said functional housing in the direction of insertion;

wherein said functional unit is disposed in said receiving space and includes a functional element being a moveable actuation element passing through said opening of said front cover element.

2. The home appliance device according to claim 1, the functional housing being implemented at least partly of plastic.

3. The home appliance device according to claim 1, the attachment element being arranged at least largely within the insulation-receiving chamber.

4. The home appliance device according to claim 1, the attachment element being implemented integrally.

5. The home appliance device according to claim 1, the attachment element having at least one recess.

6. The home appliance device according to claim 1, the attachment element being mounted to the functional housing in a mounting direction which is at least substantially perpendicular to a receiving opening of the receiving space.

7. The home appliance device according to claim 1, the attachment element being implemented at least partly of metal.

8. The home appliance device according to claim 1, the attachment element being implemented as a supporting frame which is configured for supporting the functional housing and attaching the functional housing to the home appliance housing.

9. The home appliance device according to claim 8, the attachment element having a fastening unit for fastening the attachment element to a home appliance housing.

10. The home appliance device according to claim 1, the attachment element being implemented as a cover for electronics.

11. The home appliance device according to claim 1, the functional housing being implemented self-supporting by having a reinforcement feature for at least substantially maintaining a shape of the functional housing during a foaming process of the insulation-receiving chamber.

12. The home appliance device according to claim 1, wherein said front cover element covers the receiving space and has, in at least one direction, an extension which exceeds an extension of the receiving space in said direction by at least 5%.

13. A home appliance comprising at least one home appliance device according to claim 1.

* * * * *